US005213461A

United States Patent [19]

Kalisher

[11] Patent Number: 5,213,461

[45] Date of Patent: May 25, 1993

[54] METHOD FOR RAPIDLY GENERATING PERSONALIZED BOOKS WHILE A PURCHASER WAITS

[76] Inventor: Yaakov Kalisher, c/o Best Personalized Plaza, 4350 Sigma Dr., Dallas, Tex. 75244

[21] Appl. No.: 882,827

[22] Filed: May 14, 1992

[51] Int. Cl.[5] ..... B42C 19/00

[52] U.S. Cl. ..... 412/4; 281/15.1; 283/63.1; 283/67; 283/117

[58] Field of Search ..... 281/15.1; 283/67, 63.1, 283/117; 412/19, 6, 4, 7, 8, 43

[56] References Cited

U.S. PATENT DOCUMENTS

| | | | |
|---|---|---|---|
| 1,297,131 | 3/1919 | Etheridge | 412/19 |
| 3,730,560 | 5/1973 | Abildgaard et al. | 412/43 |
| 4,498,828 | 2/1985 | Ackerman | 412/19 |

FOREIGN PATENT DOCUMENTS

| | | | |
|---|---|---|---|
| 8101384 | 3/1981 | Netherlands | 283/63.1 |

*Primary Examiner*—Paul A. Bell

[57] ABSTRACT

The disclosed method relates generally to the creation of books or documents and, more particularly, to a process for rapidly generating personalized books while a purchaser waits. In carrying out the method of the present invention, a series of steps is performed that includes loading a program having a predetermined story stored therein into a computer, entering personalized data into the computer to create a personalized story therefrom, feeding into a printing device a set of sheets having a first and second side, printing the personalized story on one of the sides of the sheets, separating the sheets transversely into pages, assembling the pages in a predetermined order and the fastening the assembled pages to a book jacket to form a personalized book. The sheets used in the disclosed method are preferably standard size, coated paper and have a partially preprinted design or illustration that partially covers the top side of each sheet, leaving blank areas for the story text, and fully covers the bottom side of the sheets.

37 Claims, 8 Drawing Sheets

METHOD FOR RAPIDLY GENERATING PERSONALIZED BOOKS WHILE A PURCHASER WAITS

BACKGROUND OF THE INVENTION

1. Field of the Invention

The invention relates generally to the creation, printing and assembling of books or documents. More particularly, it relates to the rapid generation or printing of personalized books, while a purchaser waits.

2. Description of Related Art

Currently, there exist methods for creating personalized books that incorporate into a pre-prepared general story various items of personal information, usually having to do with the purchaser and/or the intended recipient of the book, such as their names, the names of related parties, residence or geographic information, as well as other personalized information.

In particular, two methods for producing such personalized books have become known and are practiced in the industry. Each of the two methods utilizes non-standard page sizes. That is, the pages used to form the personalized book are neither letter size, $8\frac{1}{2}\times 11$ inches, legal size, $8\frac{1}{2}\times 14$ inches, or DIN A4 size, $21.0\times 29.7$ cm. paper as is regularly handled by most commercially available printers. This makes the production of books by these methods difficult, time-consuming and expensive because individual sheets are required to be hand fed, in a labor-intensive operation, through a printer. In lieu of this hand-feeding operation, a specialized printer is required to be used. In both cases, the process is expensive, either because of either the increased cost of special hardware or the increased cost of prolonged manual effort.

The first known method for producing personalized books uses non-standard size coated paper for all its pages. This method requires double printing, i.e., the printing of both text and pictures on both sides of each book sheet that is fed through the printer. Each of the non-standard size coated pages, preprinted with the book's illustrations, must be hand fed through a printing device not once, but twice, so that the printed text of the story is placed on both sides of each page, in addition to the preprinted illustrations. This creates a further disadvantage because the first pass through the printing device renders a sheet hot and somewhat damp and warped, making the required second pass through the printing device difficult. Obtaining a perfect or near-perfect sheet when such a second pass is necessary is extremely difficult and can frequently result in wasted pages and increased time and effort to produce a completed personalized book.

In the second method for generating personalized books, again using irregular size paper, the disadvantage of the two-pass method is overcome to some extent. In this second method, although text must be printed on both sides of a sheet, text and only text, without any illustrations at all, is printed only on less expensive, less fragile, non-coated paper. This rougher, plainer paper with the text printed on front and back is then interleaved with sheets of glossier, coated type paper containing only preprinted illustrations for the book. This improves somewhat the results obtained by using the two-pass text printing operation of the first method, but causes the resulting book to contain pages of vastly different textures. The interleaving of the rough, less expensive paper with the preferred, coated paper makes the final book less attractive and, therefore, less desirable.

The method of the present invention overcomes the aforementioned and other disadvantages and provides a method that is faster, more cost effective and highly desirable to purchasers. The method of the present invention solves the two-pass problem altogether by using only the glossy or coated type of paper for all pages of the book and printing text only on a single side of each sheet. This method requires, therefore, that each sheet only be fed through the printing device to affix text one time, eliminating the problems caused when a second pass is required. Requiring printing only on one side of each sheet of book pages allows coated paper, with or without illustrations, to be used throughout the book.

The resulting personalized books produced by the method of the present invention are more attractive because they contain only coated, high-quality pages, giving the book an even texture throughout. Further, because the method of the present invention utilizes standard size paper, i.e., letter, legal and A4 sizes, high-quality personalized books can be produced without the time-consuming and expensive processing of nonstandard size paper or the inevitable warping inherent in other known methods. The use of standard size pages obviates the need for manual feeding of pages into the printing device as well as the need to purchase expensive, specialized hardware or a printing device equipped with an adjustable page feeder to handle odd-size paper. Furthermore, unlike other known systems, the present invention is very flexible and can handle virtually any printer configuration; known systems are very limited as to the printers that can be utilized. All of the aforementioned features of the present invention, coupled with the use of specially marked, correlated book sheets, jackets and programs, allows personalized books of high quality to be generated in accordance with the method of the present invention within minutes, a fraction of the time required using existing methods, while a purchaser waits.

SUMMARY OF THE INVENTION

In one aspect, the present invention relates to the rapid generation of personalized books. In carrying out the principles of the present invention, in accordance with a preferred embodiment thereof, a series of steps is performed that includes loading a computer program having a predetermined story stored therein into a computer, entering personalized data to create a personalized story therefrom, feeding into a printing device a set of sheets having a first and second side, printing the personalized story on one of the sides of the sheets, separating the sheets transversely into pages, assembling the pages in a predetermined order and then fastening the assembled pages to a book jacket to form a personalized book. This approach to creating personalized books overcomes problems experienced with other methods of creating such books that required printing text on both sides of a page or sheet to be used in the book. It also overcomes the slower processing time of other methods of producing personalized books resulting, in part, from the need to print the text of the story on both sides of a page according to a manual two-pass process.

In another aspect, the present invention overcomes additional problems associated with other methods for producing personalized books by utilizing only sheets of coated or glossy paper having a partially preprinted design correlating with the book jacket already printed thereon, the paper being of a standard size. In this aspect, the present invention avoids both the need for a manual, labor-intensive hand-feed method of printing the book pages and the need to purchase expensive, specialized hardware to handle irregularly sized pages as is necessary in other known methods for creating personalized books. In a preferred embodiment thereof, the present invention utilizes 8½×11 inch, 8½×14 inch and DIN A4, 21.0×29.7 cm, size paper as standard size paper. Moreover, the present invention has enhanced flexibility over other systems because of its ability to accommodate and adjust for the incorporation of a wide variety of printing devices.

According to another aspect of the present invention, the sheets used to form the pages of a personalized book have a preprinted design fully covering the second side of each sheet and partially covering the first side of each sheet such that an area remains for printing the text of the personalized story. Additionally, the sheets for each personalized book are marked and ordered such that the first side of the top sheet represents the first and last pages of the book, with the second side of that top sheet representing the second and the next-to-the-last pages of the book and the bottom side of the bottom sheet representing the centerfold of the book. This aspect of the present invention improves, over other known methods, the efficiency with which a personalized book may be created. This is achieved by marking the sheets in such a way as to allow a computer operator to easily identify and arrange the needed sheets and quickly generate the desired book by printing the text on only one side of each standard size sheet.

In yet another aspect, the present invention for rapidly generating personalized books having jackets with a preprinted design, front and back inside covers and a plurality of sheets, each with a partially preprinted design, is carried out in accordance with a preferred embodiment thereof using a computer and a laser-type printer by loading into the computer a control program with a selected predetermined story correlating with the preprinted design of the jacket, entering personalized data as supplied by a purchaser, such as names, ages and places so that they can be inserted into the predetermined story in a manner controlled by the control program, feeding into the laser-type printer a stack of partially preprinted sheets as needed for the predetermined story, printing the story on certain story areas included on the top sides of the sheets, separating the printed sheets in half transversely to form a first and a second stack of printed pages, inverting the first stack of printed pages so that the last page is on the bottom of the first stack, forming a final stack of printed pages by stacking the second stack of printed pages on top of the inverted first stack of printed pages, so that the first page is on top of the final stack, and then securing the final stack to the covers cf the correlated jacket to form a personalized book.

The method of the present invention overcomes the disadvantages in other known methods for generating personalized books not only because it allows the use of preferred, coated paper throughout the book and requires printing only on one side of a page or sheet, but because it also improves the efficiency of producing such books through the use of standard size pages and other preprinted materials as described above.

Efficiency and timeliness in producing personalized books in accordance with the principles and aspects of the present invention is further enhanced by another aspect of the present invention in which certain correlating indicia are incorporated both in the control program designating the predetermined story and on each of the partially preprinted sheets. This allows computer operators to easily select the proper preprinted sheets for a designated program as well as corresponding jacket with its correlated preprinted design. In this aspect of the present invention, indicia are placed on each side of the preprinted sheets indicating the story title, sheet side, feed direction and page numbers of each sheet. The title and page number indicia allow a computer operator to more easily place the partially preprinted sheets in proper order for the selected predetermined story. Incorporating indicia indicating the top and bottom side of each sheet and the feed direction allows a computer operator to more easily feed the partially preprinted sheets into the printer in the proper orientation, avoiding wasted pages and reducing the time required to produce a personalized book.

In yet another aspect, the present invention comprises a rapidly generated personalized book containing a predetermined story, selected by a purchaser, with a jacket and a plurality of pages from standard size, coated paper pages, with text having been printed only on one side of each page. The present invention overcomes the disadvantages inherent in other computer-generated personalized books since the pages must only pass through the printer once. This improves efficiency and reduces waste since pages do not warp as a result of a second pass through the printer. Further, the ability to avoid using less expensive, non-coated paper for textual pages is an improvement in the overall quality and appearance of the present personalized books over those produced by other methods.

As will readily be appreciated by those of ordinary skill in the present particular art, the principles and aspects of this invention could be used to advantage in other ways, in addition to the preferred embodiment disclosed herein.

BRIEF DESCRIPTION OF THE DRAWINGS

For an understanding of the present invention and for further objects and advantages thereof, reference may now be had to the following description, taken in conjunction with the accompanying drawings, in which.

DETAILED DESCRIPTION

The generation of personalized books requires the insertion of personal data, supplied by a purchaser of such a book, into certain predetermined places throughout a generic, pre-prepared story. Until the advent of the present invention, two methods, each having problems and disadvantages, were known. In order to facilitate and make possible the production of personalized books within a timeframe acceptable (i.e., short) enough for purchasers to order the book and wait while it is made, the method of the present invention provides a process by which personalized books can be rapidly produced in a matter of minutes. The time required to produce a personalized book in accordance with the present invention ranges from approximately one-and-one-half (1½) to three (3) minutes following the entry of the personalized information into the computer.

The present invention overcomes the problems associated with the known methods by utilizing a set of specially prepared sheets of standard size coated paper to form the pages of the book. The present invention requires that these sheets be fed through a printing device to affix the text of the story only once, thereby avoiding the loss of time and warping of pages associated with two-pass printing methods. The ability to use standard size paper obviates the need to either feed sheets manually in labor intensive, time-consuming fashion or to purchase expensive special printing hardware that increases the cost to produce personalized books.

Figure 1:
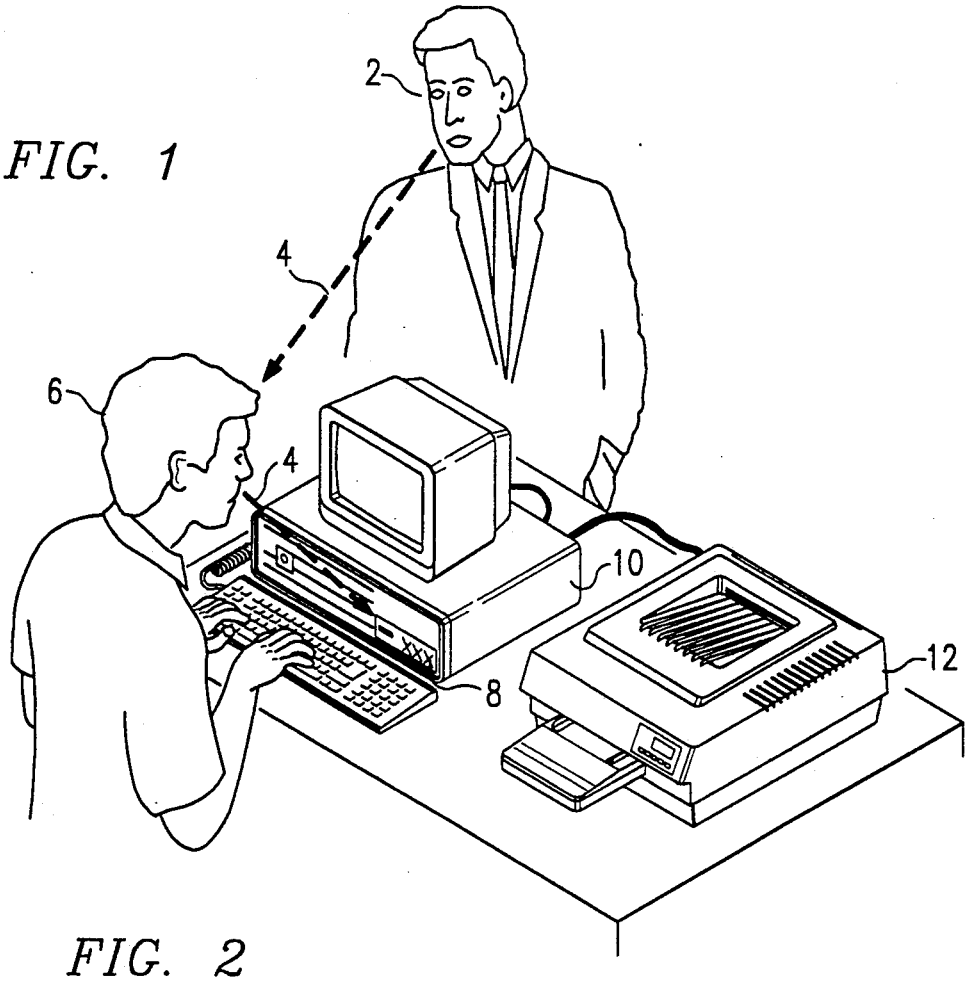
FIG. 1 is a diagram illustrating the overall process of producing a personalized book according to the method of the present invention.

Referring first to FIG. 1, there is illustrated therein the high-level, overall process involved in producing a personalized book according to the method of the present invention. As can readily be seen, a purchaser 2, after having selected a predetermined story, conveys certain personalized information 4 to a computer operator 6. The computer operator then accesses a control program 8 which has the predetermined story selected by the purchaser 2 stored on it. The control program 8 is stored in a computer 10 and is accessed by the computer operator 6. Once the control program 8 has been accessed, the computer operator 6 enters the personalized data 4 that has been provided by the purchaser 2 into the predetermined story. Once the data has been entered, the control program 8 generates a complete story that includes the personalized data 4 supplied by the purchaser 2 inserted throughout the text of the story. Once the full text, including the personalized data 4, has been generated, the information is transferred from the computer 10 to a laser-type printer 12 for printing on pre-designed sheets that will make up the pages of the final book.

Figure 2:
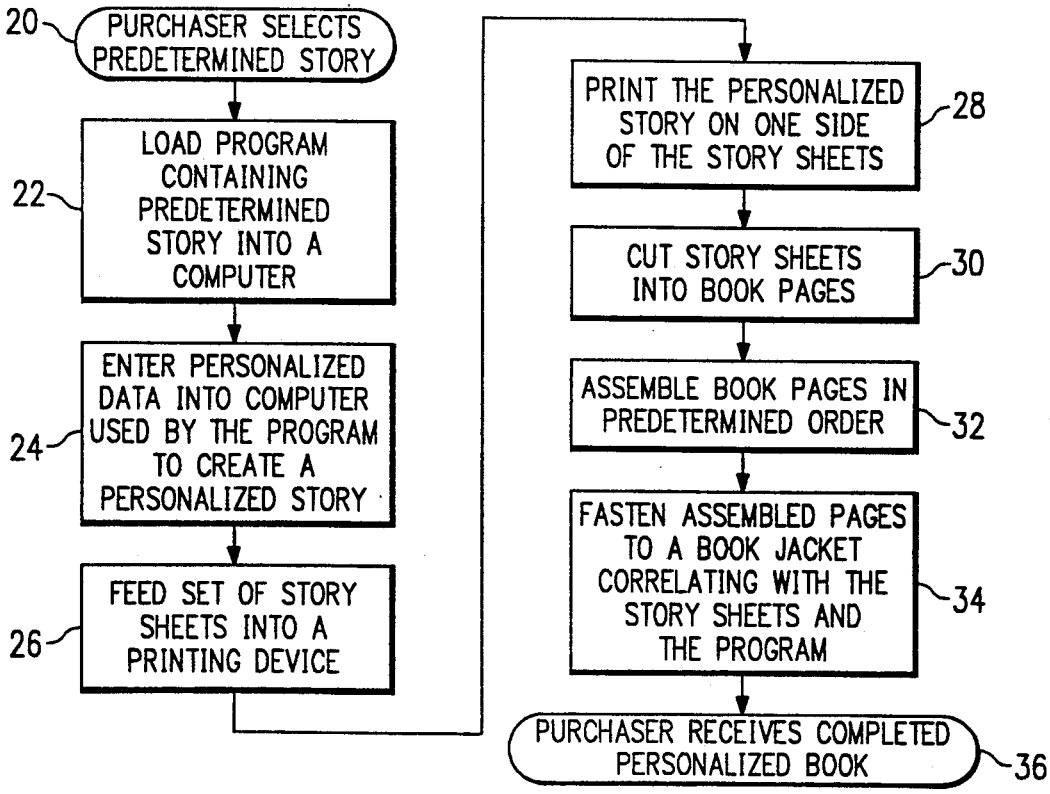
FIG. 2 is a high-level flow chart illustrating the individual steps required to produce a personalized book in accordance with the method of the present invention.

Referring next to FIG. 2, there is illustrated therein a high-level flow chart showing the individual steps required to produce a personalized book in accordance with the method of the present invention. The first step 20 requires that a purchaser 2 select a predetermined story. Once this has been accomplished, the second step 22 requires that the computer operator 6 load a control program 8 containing that selected predetermined story into the computer 10. In the third step 24, the computer operator 6 enters personalized data 4 supplied by the purchaser 2 and used by the control program 8 to create a personalized story. As illustrated, the next step 26 is to feed a set of story sheets correlated with the predetermined selected story into a printing device. The next step 28 is to print that personalized story on one side of the story sheets previously fed into the printing device. At step 30, the story sheets are cut in half to form book pages. It is recognized that other methods of separation may be employed. One such alternate method is by using perforated sheets that may be separated along the perforations. Having printed the personalized story onto the story sheets and formed the bock pages, the next step 32 is to assemble the book pages according to a predetermined order. Having assembled them into the predetermined order, the next step 34 involves fastening the assembled pages to a book jacket. The book jacket is selected to have a design correlating with the predetermined selected story and the design on the sheets on which the story was printed as well as correlating with the computer program 8 used to generate that story. In the final step 36, the purchaser 2 receives his completed book containing the personalized data 4 supplied by him during the third step 24.

Figure 3A:
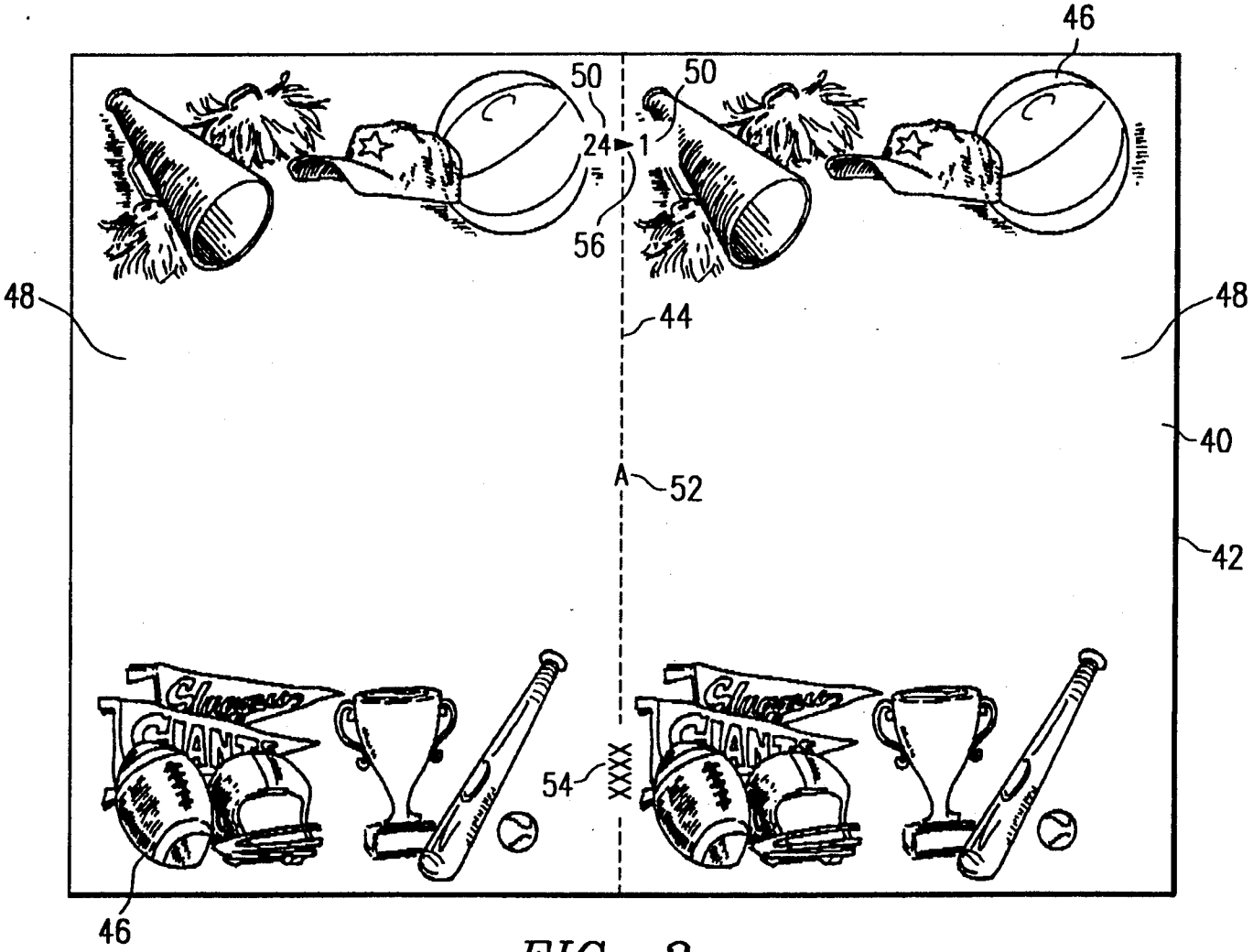
FIG. 3A illustrates the layout of the top side of the top sheet for a book having a total of twenty-four (24) pages to be made in accordance with the present invention.
Figure 3B:
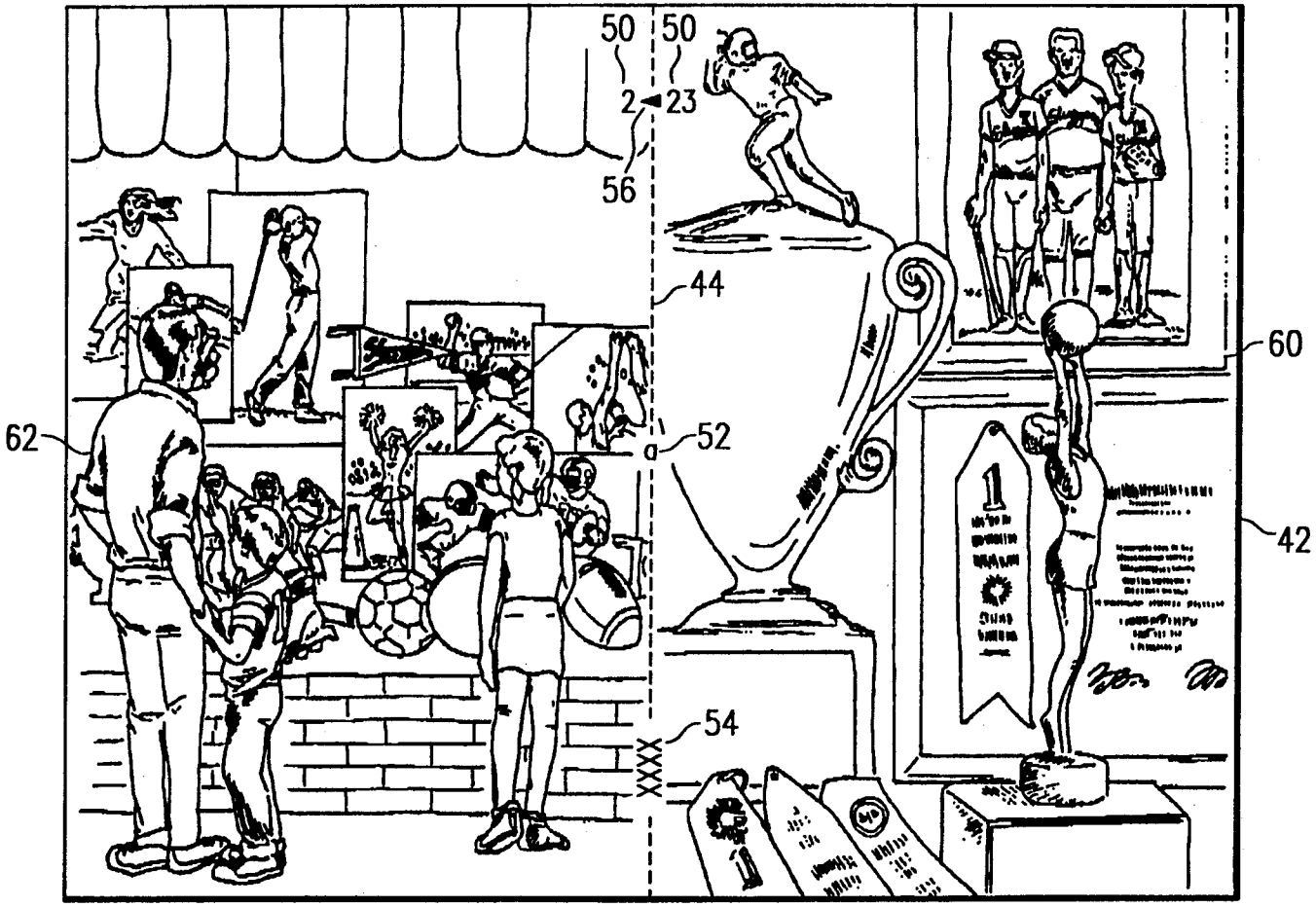
FIG. 3B is a diagrammatic illustration of the layout of the bottom side of the top sheet to be used in making a book of twenty-four (24) pages according to the present invention.
Figure 3C:
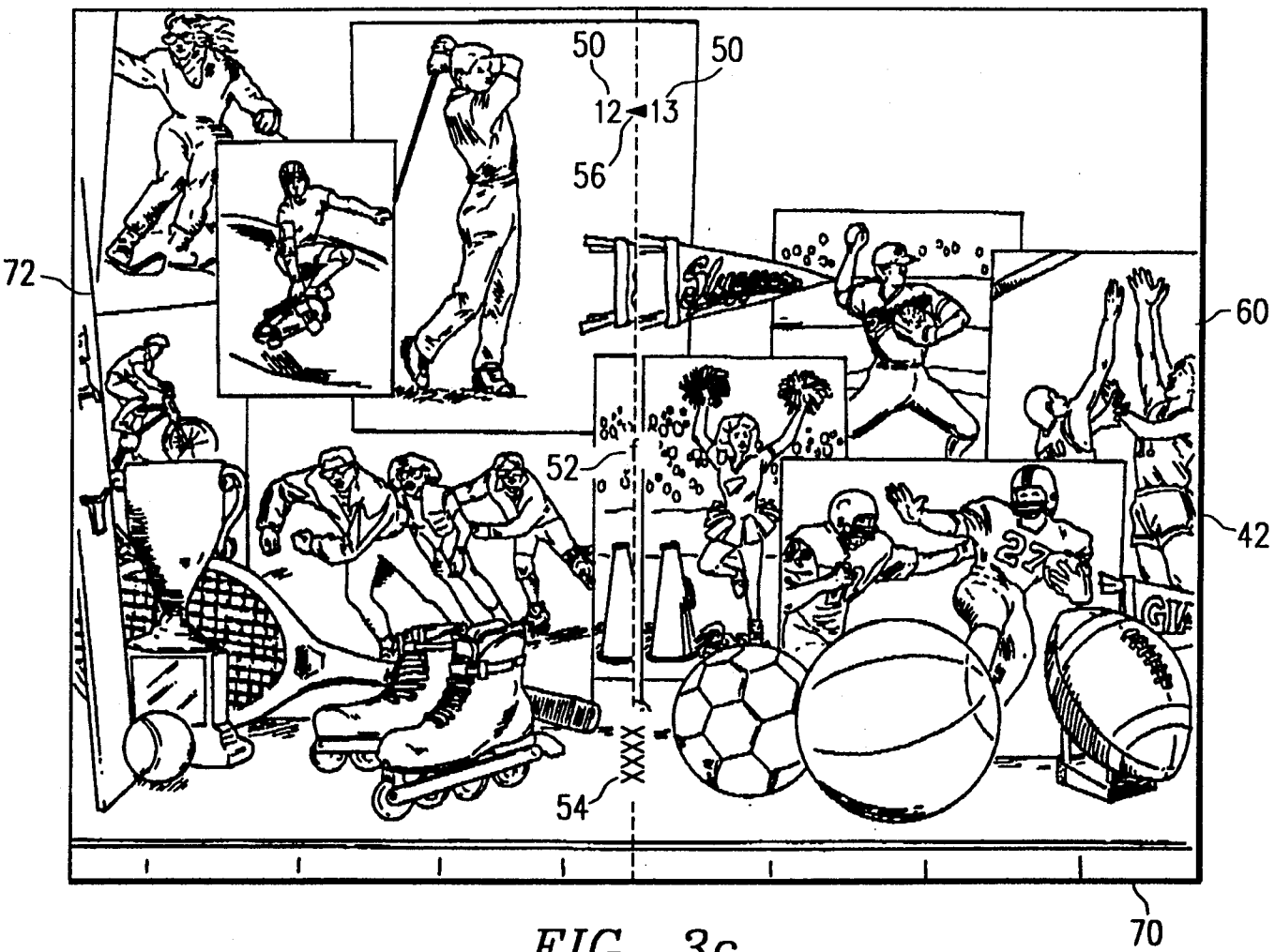
FIG. 3C is an illustration of the layout of the bottom side of the bottom sheet of a twenty-four (24) page book to be produced in accordance with the present invention.

Referring next to FIGS. 3A–3C, these schematic illustrations show various aspects of the partially preprinted sheets used in accordance with the method of the present invention to create personalized books. FIG. 3A illustrates the top side 40 of a partially preprinted sheet 42 with the design 46 partially covering the top side 40 of the preprinted sheet 42 as illustrated. As is further illustrated, there is a dashed center line 44 running transversely across the partially preprinted sheet 42. As is illustrated, the design 46 only partially covers this top side 40 of the partially preprinted sheets 42 having a blank story area 48 on either side of the dashed center line 44 in which the text of the story may be printed. The particular partially preprinted sheet 42 shown in FIG. 3A illustrates the top side 40 of what would be the first sheet used to produce a book of 24 pages as indicated by the page number indicia 50 shown in the figure. The top side 40 of the first or top sheet to be used in producing a personalized book comprises the first and the last page of the final personalized book. As can readily be seen, therefore, FIG. 3A illustrates the top side 40 of the first sheet 42 used to form a book of 24 pages in length as shown by the page number indicia 50.

As is further illustrated in FIG. 3A, each side of each partially preprinted sheet 42 contains a side indicia 52, in this case shown as the letter "A" of the English alphabet. Such side indicia 52 used in the method of the present invention consist of an upper case or capital letter indicating the top side 40 of a partially preprinted sheet 42 and a lower case letter to indicate the bottom side of the partially preprinted sheet 42. As can readily be determined, the side indicia 52 letter "A" indicates the first or top preprinted sheet 42 to be used in generating the selected personalized story, the letter "B" would indicate the second sheet to be used in producing the story, the letter "C" the third sheet, and so on.

Finally, as is also illustrated in FIG. 3A, each partially preprinted sheet 42 carries or its top side 40 a story indicia 54 that correlates the preprinted sheets 42 with the selected predetermined story in the computer program 8 and the book jacket. Finally, the top side 40 of each partially preprinted sheet 42 contains a feed direction indicia 56 that indicates the proper direction for feeding the partially preprinted sheet 42 into the laser-type printing device 12.

Referring next to FIG. 3B, there is illustrated a bottom side 60 of the first sheet 42 having a full page design 62 as illustrated in the figure. As is further illustrated in FIG. 3B, the bottom side 60 also contains the same dashed center line 44, page number indicia 50, side indicia 52—this time consisting of a lower case "a" in accordance with the preferred embodiment of the present invention—and feed direction indicia 56, again showing the proper direction for feeding the page into the laser printer 12.

Referring now to FIG. 3C there is illustrated a bottom side 60 of the bottom preprinted sheet 42 of an exemplary twenty-four (24) page, or twelve (12) sheet, personalized book. As is illustrated therein, the bottom side 60 of the bottom preprinted sheet 42 forms the centerfold 70 of the personalized book. The centerfold 70 of the exemplary book has a full page design 72 as illustrated therein. Again, FIG. 3C illustrates the same page number indicia 50, side indicia 52, story indicia 54 and feed direction indicia 56 as shown in FIGS. 3A and 3B.

Figure 4:
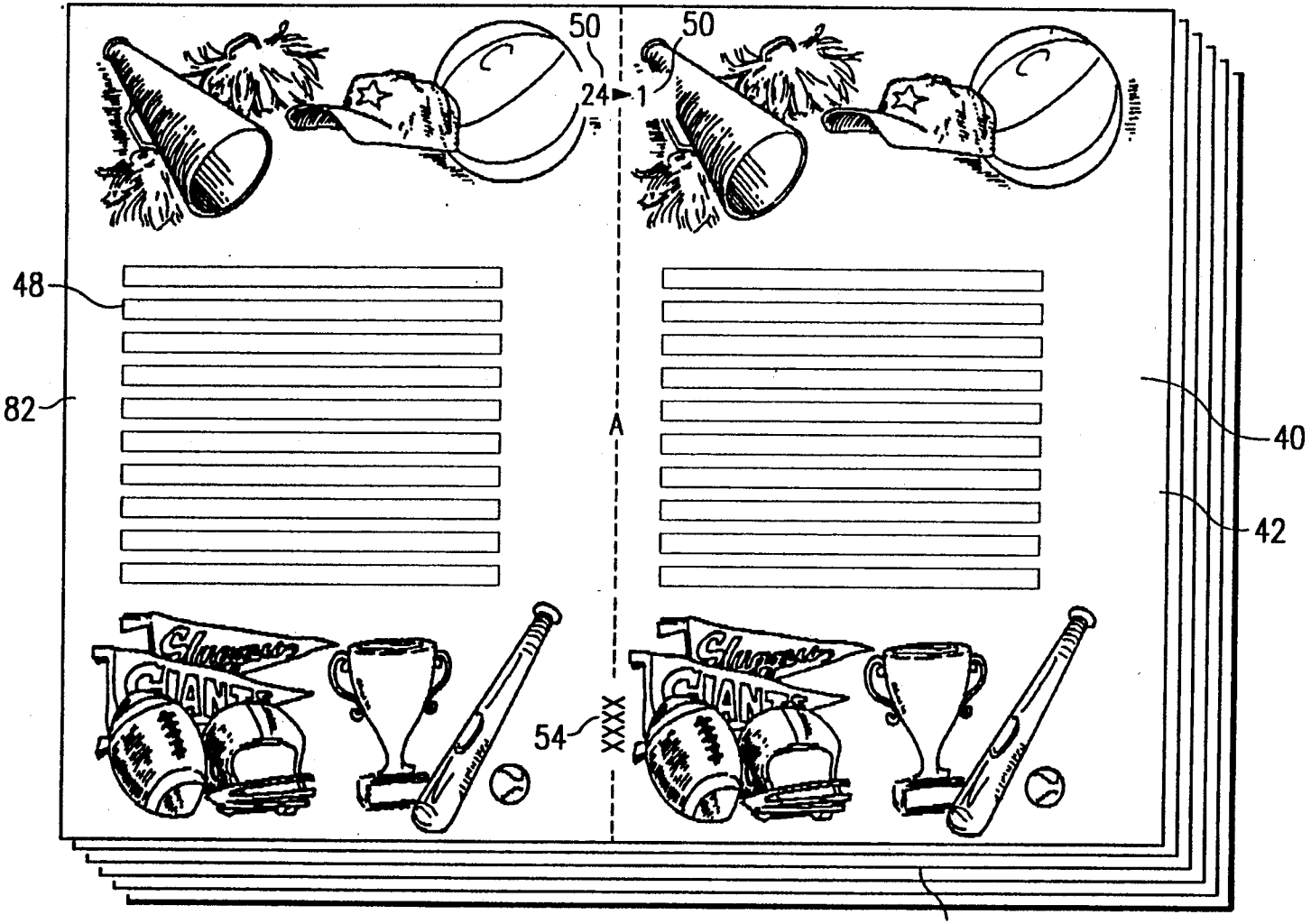
FIG. 4 is a diagrammatic illustration of the full twelve (12) sheets, including personalized printed text, stacked and ready for assembly into book form, according to the method of the present invention.

Referring next to FIG. 4 there is shown a stack 80 of printed sheets. These printed sheets are the result of feeding the set of partially preprinted sheets 42 relating to the predetermined selected story through the laser type printer 12 to generate this stack 80 of printed pages. This stack 80 of printed pages, having the text of the predetermined story already printed thereon by the laser printer 12, is stacked in a predetermined order according to the page number indicia 50 and the side indicia 52 of the method of the present invention. As is illustrated in FIG. 4, the top side 40 of the top sheet 42 of the stack 80 of printed sheets is the sheet containing the first and last pages of the exemplary twenty-four (24) page book as is shown by the page number indicia 50 indicating pages 1 and 24. It is recognized that the disclosed method and book can be applied to books of varying pages and is not limited to the illustrated 24 page book. Once the partially preprinted sheets 42 have had the text of the predetermined story containing the personalized data 4 printed in the blank story area 48 by feeding the sheets through the laser printer 12 in accordance with the method of present invention, the printed sheets form a stack 80 according to the predetermined order in accordance with the present invention. The sheets are then separated by a transverse cut, or otherwise, as illustrated in FIG. 5 in order to form the individual pages 90 of the final personalized book.

Figure 5:
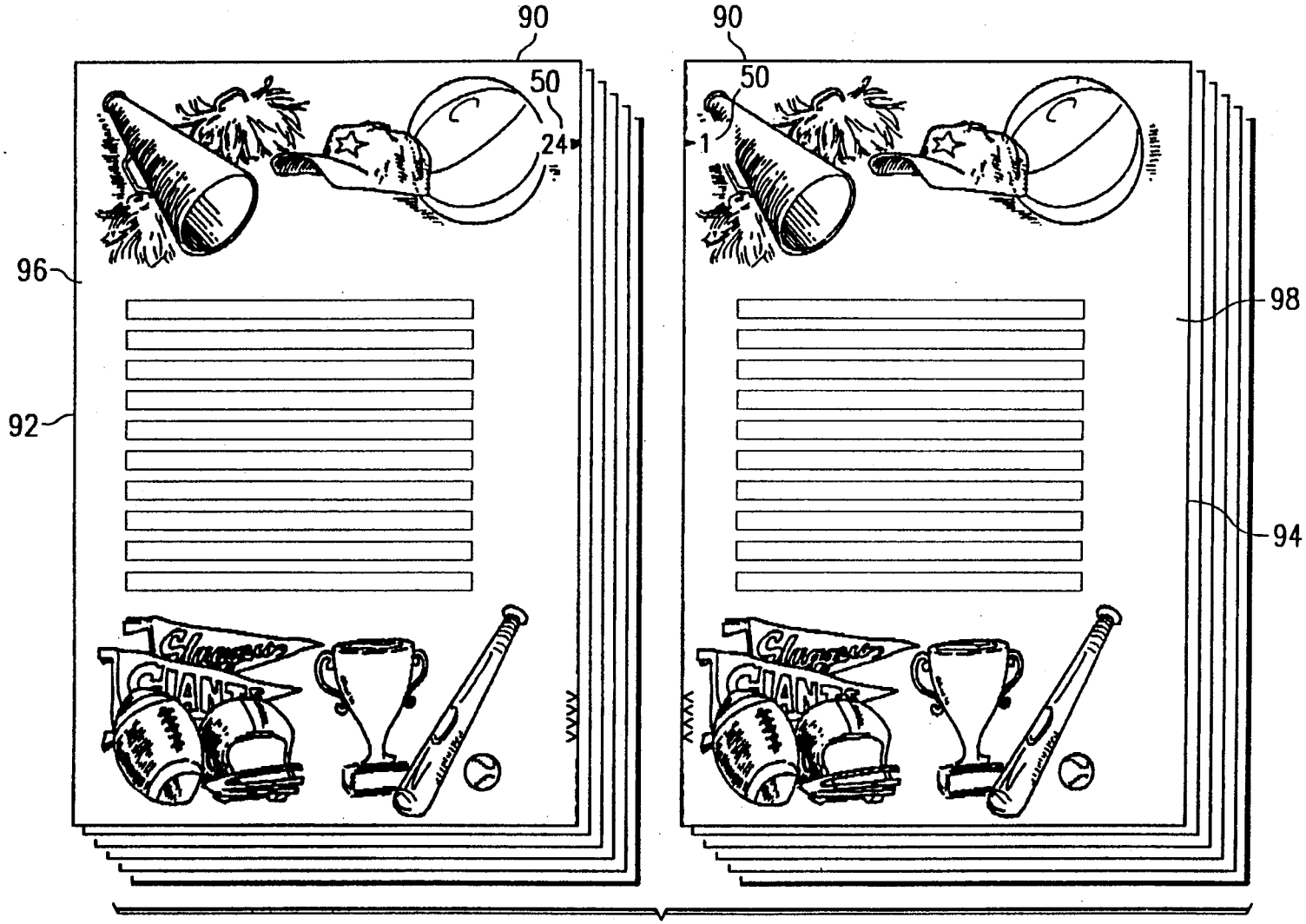
FIG. 5 illustrates the same stack of twelve (12) sheets as shown in FIG. 4, having been cut transversely to form the final book pages in accordance with the present invention.

As is illustrated in FIG. 5, once the stack 80 of printed sheets has been separated transversely, the result is a first stack 92 and a second stack 94 of individual pages 90. In the illustrated embodiment the separation is by cutting, but may be by other means as well, such as using perforated sheets, without departing from the invention disclosed and claimed. As is further illustrated in FIG. 5, the first stack 92 has as its top sheet 96 the final page of the exemplary twenty-four (24) page book or page 24, as indicated by the page number indicia 50. The second stack 94 of individual book pages 90 has as its top sheet 98 the first page of the final personalized book. In order to form the final personalized book in accordance with the preferred embodiment of the present invention, the first stack 92 must first be inverted such that the last page of the twenty-four (24) page book, which is the top page 96 of the first stack 92, is on the bottom of that first stack 92. Next, the second stack 94 is placed on top of the inverted first stack 92 to form a single final stack 100 as illustrated in FIG. 6.

Figure 6:
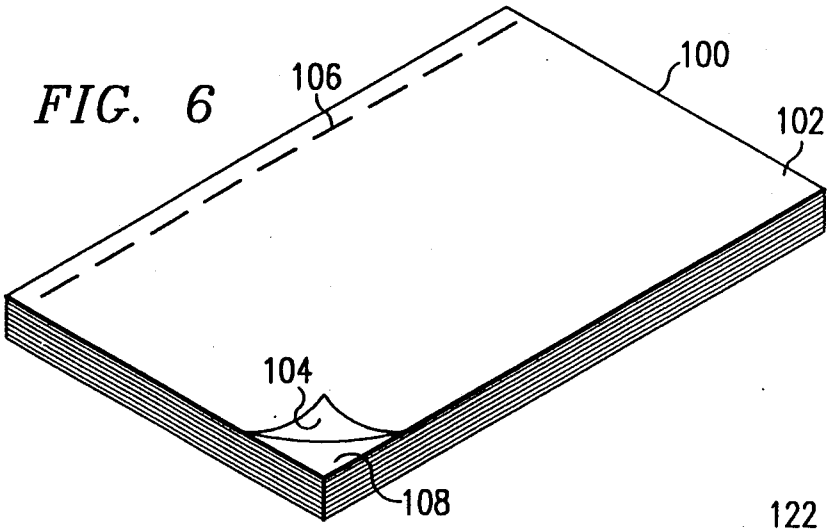
FIG. 6 is an illustration of the assembled set of pages for a book to be produced in accordance with the method of the present invention.
Figure 7:
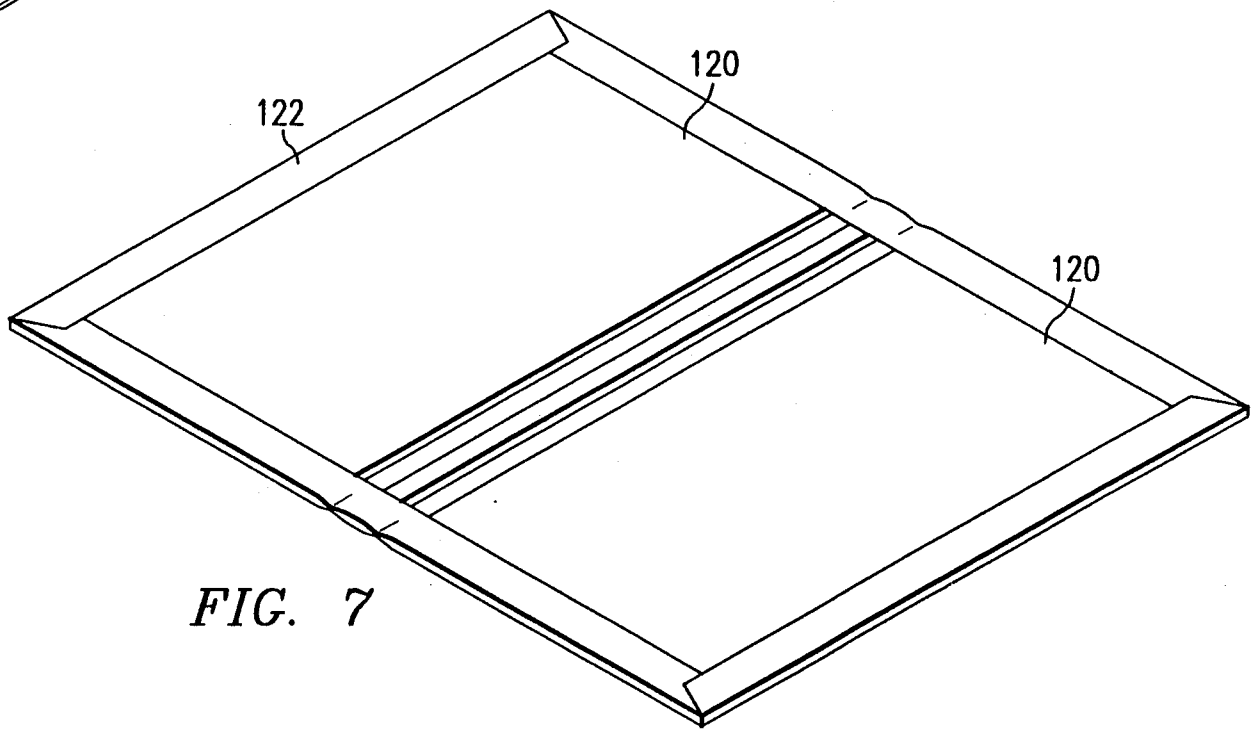
FIG. 7 is a representation of the empty jacket to which the book pages will be attached in order to form a personalized book in accordance with the present method.

As can also be seen in FIG. 6, this final stack 100 is covered on both its top and bottom side by cover pages 102, each of which has a protective covering 104. Once these cover pages 102 have been added to the top and bottom sides of the final stack of pages 100, the final stack 100, along with the cover pages 102, are stapled along one edge thereof as shown at 106. Each of the covered pages 102 is coated with an adhesive coating 108 so that the cover pages 102 may be secured or fastened to the inside covers 120 of the empty book jacket 122 that corresponds to the predetermined and selected story as illustrated in FIG. 7. As can readily be seen from FIG. 6, when the final stack 100 with the cover pages 102 is ready to be secured to the book jacket 122 as shown in FIG. 7, the protective covering 104 may simply be pealed back to expose the adhesive coating 108 contained on the cover pages 102.

Figure 8:
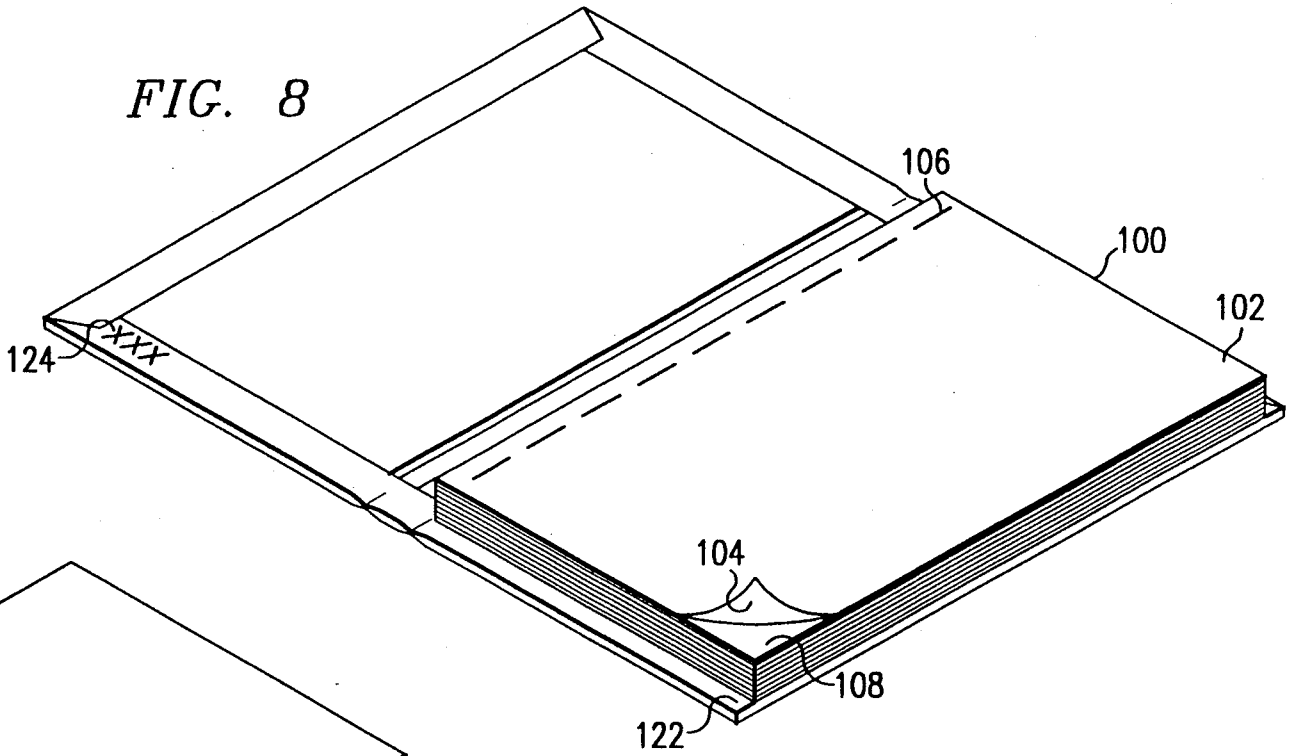
FIG. 8 illustrates the fastening of the printed pages of the book to the jacket in accordance with the present invention.

Finally, as is illustrated in FIG. 8, the protective covering 104 on the bottom cover page 102 may be pealed back and removed and the final stack 100 may be secured to the back inside cover 120 of the book jacket 122. Having secured one cover page 102, the protective covering 104 may be removed from the second cover page 102 and that cover page 102 may then be secured to the other inside cover 120 of the jacket 122. As is further illustrated by FIG. 8, the jacket 122 contains a story indicia 124 that correlates the design of the jacket 122 to the predetermined and selected story, to the control program 8 and to the partially preprinted sheets 42 of the selected story.

Figure 9:
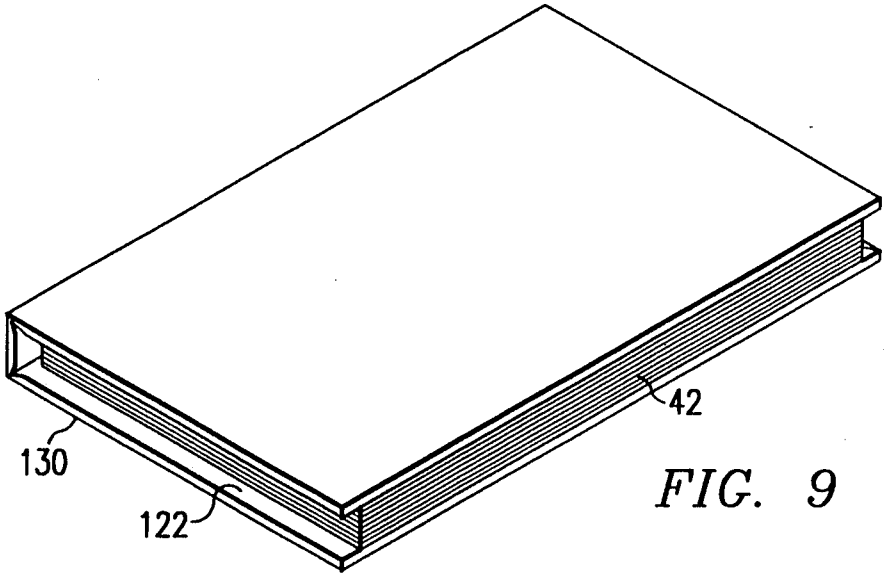
FIG. 9 is an illustration of the final, rapidly generated personalized book according to the present invention as produced in accordance with the method of the present invention.

Once the second cover page 102 is secured to the second inside cover 120 of the book jacket 122 there is formed a final personalized book 130 that was rapidly generated while the purchaser waited and that includes personalized data 4 provided by the purchaser 2. The final personalized book 130 also contains a jacket 122 having a design that correlates to the predetermined story stored in the control program 8 and illustrated on the partially preprinted sheets 42 as shown in FIG. 9.

It is thus believed that the operation and construction of the present invention will be apparent from the foregoing description. While the method and resulting personalized book shown and described has been characterized as being preferred, it will be readily apparent that various changes and modifications can be made therein without departing from the spirit and scope of the invention as defined in the following claims.

What is claimed is:

1. A method of quickly generating a personalized book having pages in a predetermined order comprising the steps of:

loading a program having a predetermined story stored therein into a computer;

entering personalized data into the computer and creating a personalized story using the predetermined story and personalized data;

ordering a set of partially preprinted sheets having a first and second side such that the first side of the top sheet of said set of sheets represents the first and last pages of the personalized book, the second side of the top sheet of said set of sheets represents the second and next-to-last pages of the book and the bottom side of the bottom sheet of said set of sheets represents the centerfold of the book;

feeding into a printing device said set of sheets;

printing said personalized story only on one of said sides of said sheets;

separating said sheets transversely into pages;

assembling said pages in said predetermined order; and fastening the assembled pages to a book jacket.

2. The method of claim 1 further comprising the step of cutting said sheets to form a first and a second stack of cut pages.

3. The method of claim 2 wherein the step of assembling said pages in a predetermined order further comprises the steps of:

inverting the first stack of cut pages that includes the last page such that the last page is on the bottom of the first stack; and forming a final stack of pages by stacking the second stack of cut pages on top of the inverted first stack of cut pages such that the first page is on top of the final stack and the last page is on the bottom of the final stack.

4. A method of rapidly generating a personalized book using a computer controlled laser-type printer, the personalized book having a jacket with a preprinted design and with a front and a back inside cover and a having a plurality of sheets, each sheet having a partially preprinted design correlated with the jacket design, said method comprising the steps of:

loading into the computer a control program having a predetermined story stored thereon that correlates with the preprinted design of the jacket;

entering personalized data such as names, ages and places into the computer to be inserted into the predetermined story in a manner controlled by the control program;

feeding into the laser-type printer a stack, having a top and bottom sheet, of the partially preprinted sheets needed for the predetermined story, each partially preprinted sheet comprising standard size coated paper having the preprinted design fully covering the bottom side of the sheets and having the preprinted design only partially covering the top side of the sheets, leaving a blank story area thereon, the preprinted design correlating with the preprinted design of the jacket, the top side of the top sheet of the stack representing the first and last pages of the book and the bottom side of the bottom sheet representing the centerfold of the book;

printing the predetermined story on the story areas of the top side of the sheets, each sheet comprising two book pages;

separating the printed sheets in half transversely to form a first and a second stack of printed pages;

inverting the first stack of printed pages that includes the last page such that the last page is on the bottom of the first stack;

forming a final stack of printed pages by stacking the second stack of printed sheets that includes the first page such that the first page is on the top of the second stack on top of the inverted first stack of printed pages such that the first page is on top of the final stack; and securing the final stack to the front and back inside covers of the jacket to form a personalized book.

5. The method of claim 4 wherein said separation is by cutting.

6. The method of claim 4 wherein said separation is by tearing along a perforation.

7. The method of claim 4 wherein the step of securing the final stack to the front and back inside covers of the jacket comprises the steps of:

placing a cover sheet on the top and on the bottom of the final stack, each cover sheet having an adhesive material on the top side thereof protected by a removable covering;

stapling the final stack and the top and bottom cover sheets together along one edge thereof;

inserting the stapled stack in the book jacket with the preprinted design;

removing the protective covering from the top and bottom cover sheets; and adhering the top cover sheet to the front inside cover of the jacket and the bottom cover sheet to the back inside cover of the jacket.

8. A method as in claim 4 further comprising the steps of:

placing indicia in the control program designating the predetermined story; and placing corresponding indicia on the partially preprinted sheets that correlate the sheets with the control program such that a computer operator may easily select the proper preprinted sheets for a designated control program and the correlating preprinted design for the corresponding jacket.

9. A method is in claim 8 further comprising the step of placing indicia on the partially preprinted sheets to specify the page numbers of the two book pages comprising each sheet such that a computer operator may easily place the partially preprinted sheets in proper order in accordance with the predetermined story.

10. A method as in claim 8 further comprising the step of placing indicia on each side of the partially preprinted sheets that indicate the top and bottom side of each partially preprinted sheet such that a computer operator may properly feed the partially preprinted sheets into the laser-type printer.

11. A method as in claim 10 wherein the step of placing indicia to indicate the top and bottom sides further comprises the step of using an uppercase letter to indicate the top side and the same letter in lowercase to indicate the bottom side such that the indicia indicating the top side of the top sheet comprises the letter "A" and the indicia for each successive sheet comprises the next successive letter of the English alphabet.

12. A method as in claim 8 further comprising the step of placing indicia on each side of the partially preprinted sheets indicating the proper direction for feeding the preprinted sheets into the printer.

13. A method as in claim 4 further comprising the step of using $8\frac{1}{2} \times 11$ inch paper as the standard size coated paper.

14. A method as in claim 4 further comprising the step of using $8\frac{1}{2} \times 14$ inch paper as the standard size coated paper.

15. A method as in claim 4 further comprising the step of using A4 DIN size paper, sized 21.0×29.7 cm, as the standard size coated paper.

16. A method of printing a personalized book with a computer operated laser printer while a purchaser waits, the personalized book having a jacket with a preprinted design and pages having a correlating partially preprinted design, the method comprising the steps of:

inserting a control program in the computer having a predetermined story therein that correlates with the jacket having a related preprinted design;

entering personal data such as names and places into the computer to be inserted in the predetermined story as determined by the control program;

inserting partially preprinted sheets necessary for the story in the laser printer, each preprinted sheet comprising four numbered book pages per sheet on standard size coated paper and having only the preprinted design on the bottom side thereof and the partially preprinted design covering the top side so as to leave a blank area thereon for the printed story, the preprinted design correlating with the jacket design, the top side of the top sheet representing the first and last pages of the book and the bottom side of the bottom sheet representing the centerfold of the book;

printing the personalized story on the top side of the preprinted sheets in the blank printed story area;

separating the printed sheets in half transversely to form a stack of sequentially numbered top pages and a stack of continuing sequentially numbered bottom pages in reverse sequential order;

inverting the stack of bottom pages and placing the stack of top pages on the stack of inverted bottom pages to form a stack of sequentially numbered pages having the predetermined story thereon;

placing a cover sheet onto the top and bottom of the page stack, each cover sheet having glue on one side thereof protected by a covering;

stapling the page stack and cover sheets together along one edge thereof;

inserting the stapled stack in the book jacket with the related preprinted design;

removing the protective cover from each of the cover sheets to expose the glue; and adhering the glue surface of the cover sheets to the inside of the book jacket to form a personalized book.

17. The method of claim 16 wherein said separation is by cutting.

18. The method of claim 16 wherein said separation is by tearing along a perforation.

19. A method as in claim 16 further comprising the steps of:

placing indicia on the control program designating the predetermined story; and placing corresponding indicia on the partially preprinted sheets that correlate the preprinted sheets with the control program such that a computer operator may easily select the proper preprinted sheets for a designated control program.

20. A method as in claim 19 further comprising the step of placing indicia on the partially preprinted sheets to specify page numbers of the book pages comprising each sheet such that a computer operator may easily place the partially preprinted sheets in proper sequential order in accordance with the predetermined story.

21. A method as in claim 19 further comprising the step of placing indicia on each side of the partially preprinted sheets that indicate the top and bottom side of each partially preprinted sheet such that a computer operator may properly feed the partially preprinted sheets into the printer.

22. A method as in claim 21 wherein the indicia indicating the top and bottom sides comprises an upper case letter to indicate the top side and the same letter in lowercase to indicate the bottom side such that the indicia indicating the top side of the top sheet comprises the letter "A" and the indicia for each successive sheet comprises the next successive letter of the English alphabet.

23. A method as in claim 19 further comprising the step of placing indicia indicating the proper direction for feeding the preprinted sheets into the printer.

24. A method as in claim 16 further comprising the step of using 8½×11 inches paper as the standard size coated paper.

25. A method as in claim 16 further comprising the step of using 8½×14 inches paper as the standard size coated paper.

26. A method as in claim 16 further comprising the step of using 21.0×29.7 cm, DIN size A4 paper as the standard size coated paper.

27. A method of rapidly generating a personalized book using a computer controlled printer, the personalized book having a jacket with a preprinted design and with a front and a back inside cover and a having a plurality of sheets, each sheet having a partially preprinted design correlated with the jacket design, said method comprising the steps of:

loading into the computer a control program having a predetermined story stored thereon that correlates with the preprinted design of the jacket;

entering personalized data such as names, ages and places into the computer to be inserted into the predetermined story;

feeding into the printer a stack of partially preprinted sheets, each sheet containing four pages needed for the predetermined story and having a first and second side, a preprinted design fully covering the first side of each sheet and a preprinted design partially covering the second side of each sheet leaving a story area thereon, the preprinted design correlating with the preprinted design of the jacket;

creating a personalized story using the predetermined story and personalized data;

printing the personalized story on the story areas;

separating the printed sheets in half to form book pages;

forming a final stack of printed pages by colating the book pages; and securing the final stack to the front and back inside covers of the jacket to form a personalized book.

28. The method of claim 27 wherein said separation is by cutting.

29. The method of claim 27 wherein said separation is by tearing along a perforation.

30. The method of claim 27 wherein the size of said partially preprinted sheets is 8½×11 inches.

31. The method of claim 27 wherein the size of said partially preprinted sheets is 8½×14 inches.

32. The method of claim 27 wherein the size of said partially preprinted sheets is A4 DIN size paper, sized 21.0×29.7 cm.

33. The method of claim 27 wherein said printer is a laser-type printer.

34. A method is in claim 27 wherein said partially preprinted sheets include indicia to specify the page numbers of the two book pages comprising each sheet such that a computer operator may easily place the partially preprinted sheets in proper order in accordance with the predetermined story.

35. A method as in claim 27 wherein said partially preprinted sheets include indicia that indicate the top and bottom side of each partially preprinted sheet such that a computer operator may properly feed the partially preprinted sheets into the laser-type printer.

36. A method as in claim 35 wherein said indicia includes an uppercase letter to indicate the top side and the same letter in lowercase to indicate the bottom side such that the indicia indicating the top side of the top sheet comprises the letter"A" and the indicia for each successive sheet comprises the next successive letter of the English alphabet.

37. A method as in claim 27 wherein said partially preprinted sheets include indicia to indicate the proper direction for feeding the preprinted sheets into the printer.

* * * * *